United States Patent [19]

Ham

[11] Patent Number: 4,609,195

[45] Date of Patent: Sep. 2, 1986

[54] MECHANICAL BOXING TOY

[76] Inventor: Yong S. Ham, Jangmi Apt. 12-1105, Shinchun-Dong, Kangnam-Ku, Seoul, Rep. of Korea

[21] Appl. No.: 735,601

[22] Filed: May 20, 1985

[30] Foreign Application Priority Data

May 21, 1984 [KR] Rep. of Korea ..... 4792

[51] Int. Cl.[4] ..... A63F 9/00; A63H 13/06

[52] U.S. Cl. ..... 273/85 F; 446/198; 446/334

[58] Field of Search ..... 273/85 F, 85 H; 446/334, 335, 198

[56] References Cited

U.S. PATENT DOCUMENTS

| | | | |
|---|---|---|---|
| 1,781,307 | 11/1930 | Veronda | 446/335 |
| 2,435,141 | 1/1948 | Koci | 446/335 |
| 3,845,956 | 11/1974 | Goldfarb et al. | 273/85 F |

FOREIGN PATENT DOCUMENTS

| | | | |
|---|---|---|---|
| 772876 | 12/1967 | Canada | 273/85 F |
| 466416 | 10/1928 | Fed. Rep. of Germany | 446/334 |
| 525146 | 4/1955 | Italy | 273/85 F |

*Primary Examiner*—Paul E. Shapiro

*Attorney, Agent, or Firm*—Birch, Stewart, Kolasch & Birch

[57] ABSTRACT

A mechanical boxing toy comprising a baseplate, two opposing mechanical boxing dolls containing flexible and extendable arms, the dolls being slidably and rotatably mounted on the baseplate, a moving plate of the dolls, an air pipe for supplying the air to the arms of the dolls to extend the arms, a lever and a wire for raising and lowering the arms of the boxing dolls, and electric microswitches selectively located on the dolls for recording when contact is made between the respective dolls and counting the score between the respective dolls.

4 Claims, 4 Drawing Figures

MECHANICAL BOXING TOY

BACKGROUND AND FIELD OF THE INVENTION

The present invention relates to a mechanical boxing toy and more particularly to a movable boxing toy comprising rival boxing dolls which are capable of hitting each other through the minipulation of game players and recording a score. The mechanical boxing toy of the present invention is a movable fighting toy for use by children.

Many types of movable toys in various fields have been developed and are used extensively in the toy industry. However, none of these toys are movable boxing toys which can be played through the operation of a handle and the pressure of a balloon rubber button.

OBJECTS AND SUMMARY OF THE INVENTION

It is therefore an object of the present invention to provide a movable mechanical boxing toy.

It is another object of the present invention to provide a movable boxing toy game which can be played by two parties.

It is a further object of the present invention to provide a game machine which children can easily play both mechanically and intellectually so as to improve their intellectual talent.

Still another object of the present invention is to provide a movable, simple and inexpensive toy which everyone can use and enjoy almost anywhere.

Other objects and further scope of applicability of the present invention will become apparent from the detailed desscription given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention pertains to a movable boxing toy which utilizes boxing dolls which are rotatable and slidably movable and are provided with arms which can be raised and lowered by wires and levers and which can be extended by air to contact the opponent's doll. The contact made by one doll on the other is measured by electric microswitches and recorded.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PRESENT INVENTION

Figure 1:
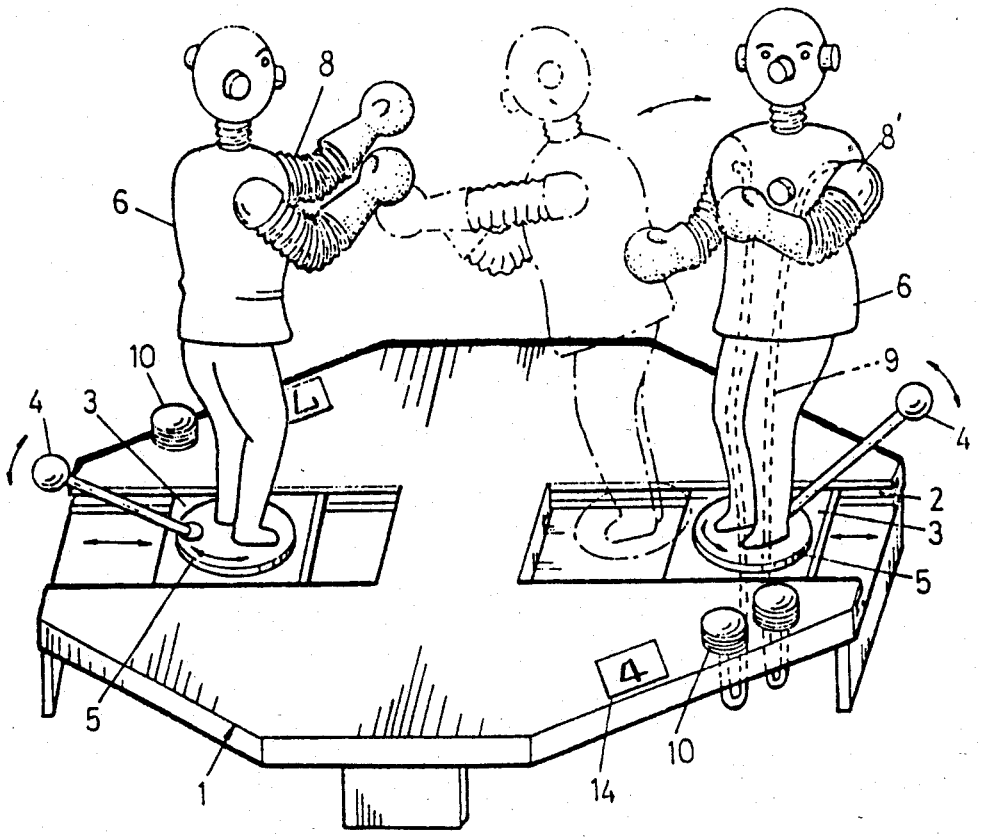
FIG. 1 is a perspective view of a mechanical boxing toy of the present invention.
Figure 3:
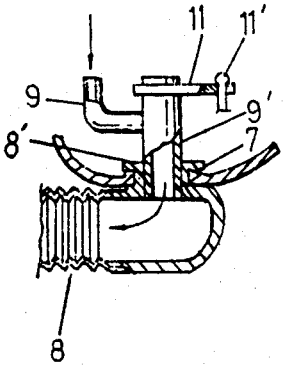
FIG. 3 is a cross-sectional view of a flexible arm of the boxer of FIG. 2 of the present invention.
Figure 4:
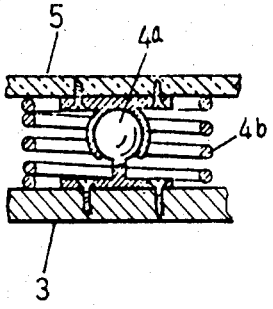
FIG. 4 is a cross-sectional view of a moving plate of FIG. 2 showing a supporting circle plate secured to a baseplate of the present invention.
Figure 2:
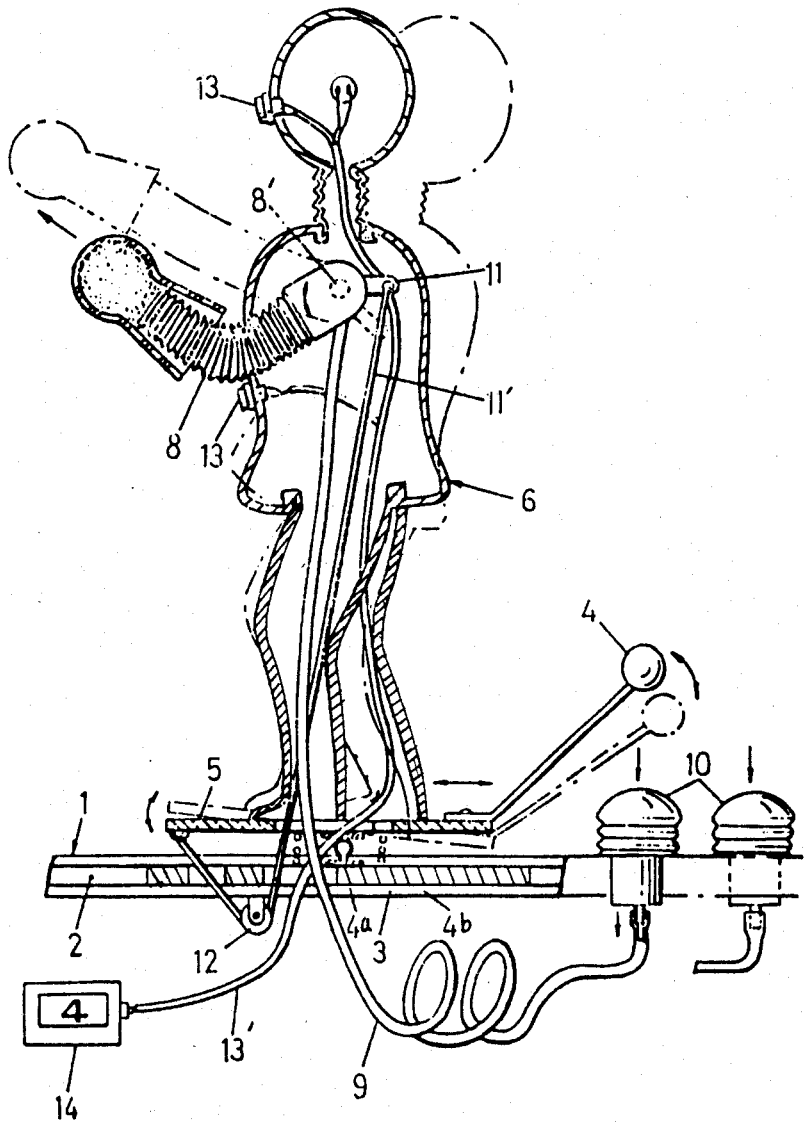
FIG. 2 is a cross-sectional view of the boxer doll of FIG. 1 showing how the doll moves during the operation of the toy of the present invention.

The mechanical boxing toy of the present invention comprises a baseplate 1 and boxer dolls 6 disposed on the baseplate 1 as shown in FIG. 1. The baseplate 1 is provided with grooves 2, containing moving plates 3 which are slidably mounted to move forward and backward within the grooves 2. Supporting circle plates 5, rotatably supported on plates 3, have dolls 6 and handles 4 secured thereto for playing the game. Also, balloon buttons 10 are provided for pushing and supplying air into the flexible furrowed arms 8 so as to extend them, as desired. Finally, electric counting elements 14 are utilized for keeping score. The boxer doll 6, as shown in FIG. 2, is provided with an air pipe 9 therein which is utilized to connect the balloon buttons 10 to the flexible furrowed arms 8. Electric microswitches 13 are positioned in the nose, ears and heart of the boxers for recording blows to these areas and for recording points utilizing lead wires 13' which connect the electric microswitches 13 to the electric counting element 14. When the electric microswitch 13 is hit by the glove of the opposing doll, the score appears on the electric counting element 14. The furrowed arms 8 are secured to a shoulder hole 7 of the doll through a moving plug 8' which is connected to the inlet tube 9'(FIG. 3). The moving plug 8' is fixed to a lever 11 which is connected to a conducting roller 12 by a wire 11', with the end of wire 11' being fixed to the moving plate 5 which, in turn, is provided with handle 4, as shown in FIGS. 2 and 3. FIG. 4 shows the supporting circle plate 5 which is rotatably secured to the moving plate 3 through a ball joint **4*a* and a spring 4*b* whereby the circle plate 5 having the boxer doll 6** disposed thereon can be moved forward and backward, and rotated to the right and left side directions.

When playing, two opposing players operate the handles 4 and balloon buttons 10, respectively, for obtaining high scores. The operation of the handle 4 causes the boxer doll 6 to go forward and backward and rotate. The arms 8 are caused to go up and down through the cooperation of plate 5, conducting rollers 12, lever 11' and wire 11', the inlet tube 9' and the moving plug 8'. Pressing the balloon buttons 10 enlarges the arms 8 so as to hit the microswitches 13 of the opponent's boxer doll 6. When the gloves of the arms 8 contact the microswitches 13 of the opponent's doll 6 (FIG. 1), the score is added on the counting elements 14 through the electric wires 13'. As described above, in order to win the game, players have to control the boxer by hitting the microswitches 13 of the boxer doll 6 of the other party; avoid the enemy's attack; and obtain a higher score than the opponent. Accordingly, the mechanical boxing toy of the present invention is a useful device for improving the intellectual talents and enhancing the enjoyment of children.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A mechanical boxing toy comprising:

a baseplate containing opposing circle plates, each circle plate being rotatably connected through a ball joint and spring means to moving plates, said moving plates being slidable toward and away from each other within said base plate, two opposing mechanical boxing dolls containing flexible and extendable arms, said dolls being mounted on said circle plates, handle means attached to said circle plates for sliding the dolls toward or away from each other and for rotating the dolls in place, means for selectively supplying air to the arms of the dolls to extend the arms, means for selectively raising and lowering the arms of the boxing dolls, and electric microswitches selectively located in the dolls for recording when contact is made between the respective dolls and counting the score between the respective dolls.

2. The mechanical boxing toy of claim 1, wherein compressible air buttons are connected by tube means to the arms of the dolls, whereby, by compressing the air buttons, air is transferred to the arms of the dolls to cause them to be extended.

3. The mechanical boxing toy of claim 1, wherein lever means and wire means connect the arms to the circle plate whereby, by compressing the circle plate toward the moving plate against the action of the spring, the arms of the dolls can be raised and lowered.

4. The mechanical boxing toy of claim 1, wherein the electric microswitches are connected by electrical wires to electric counting elements.

* * * * *